United States Patent [19]

Röck et al.

[11] 4,103,394

[45] Aug. 1, 1978

[54] DOOR HINGE

[75] Inventors: Erich Röck, Höchst; Bernhard Mages, Dornbirn, both of Austria

[73] Assignee: Julius Blum Gesellschaft m.b.H., Hochst

[21] Appl. No.: 779,230

[22] Filed: Mar. 18, 1977

[30] Foreign Application Priority Data

Apr. 8, 1976 [AT] Austria ..... 2569/76

[51] Int. Cl.[2] ..... E05D 7/04

[52] U.S. Cl. ..... 16/129

[58] Field of Search ..... 16/129, 130, 131, 132, 16/133, 134

[56] References Cited

U.S. PATENT DOCUMENTS

| | | | |
|---|---|---|---|
| 3,772,735 | 11/1973 | Ladtenschlaeger | 16/129 |
| 3,952,366 | 4/1976 | Rock et al. | 16/129 |
| 3,977,042 | 8/1976 | Rock et al. | 16/129 |
| 3,977,042 | 8/1976 | Ladtenschlaeger | 16/130 |

FOREIGN PATENT DOCUMENTS

| | | | |
|---|---|---|---|
| 2,513,089 | 10/1975 | Fed. Rep. of Germany | 16/129 |
| 2,356,000 | 5/1975 | Fed. Rep. of Germany | 16/129 |
| 2,460,127 | 6/1976 | Fed. Rep. of Germany | 16/129 |
| 2,020,591 | 11/1971 | Fed. Rep. of Germany | 16/130 |

*Primary Examiner*—James Kee Chi

*Attorney, Agent, or Firm*—Haseltine, Lake & Waters

[57] ABSTRACT

A door hinge, particularly for furniture doors, which includes a hinge casing and a hinge arm interconnected by links pivotally mounted on the hinge casing and the hinge arm by means of pivot pins. The hinge arm is fixable onto a mounting plate that is securable to a furniture element, for example a side-panel. Stops are provided that facilitate the positioning of the hinge arm on the mounting plate.

12 Claims, 19 Drawing Figures

DOOR HINGE

BACKGROUND OF THE INVENTION

FIELD OF THE INVENTION

The invention relates to a hinge particularly for pieces of furniture with a mounting plate which can be positioned on one of their structural parts, for example on a side-panel of the corpus, and on which a hinge arm that carries links or the like can be directly or indirectly anchored.

DESCRIPTION OF THE PRIOR ART

Hinges with mounting plates of this kind have been used in furniture industry and on a particularly wide scale in the production of kitchen furniture. If these hinges are applied the mounting plate is fixed to a part of the piece of furniture, for example to one of its side-panels, by screws, dowels or the like and the hinge arm which is linked to a hinge casing or the like by a link is positioned on the mounting plate when the door wing of the piece of furniture is put on its hinges.

Thus preparatory assembling work can be done. As mentioned above the mounting plate is first fixed to the side-panel of the piece of furniture and second the hinge casing to which the hinge arm is linked is inserted into a corresponding dowel hole of the door wing of the piece of furniture.

These hinges should fulfil two essential requirements. When the door wing of the piece of furniture is put on its hinges the hinge arm should quickly be anchored and kept in position on the mounting plate so that the weight of the door wing of the piece of furniture need not be carried too long. Further, one or more adjustabilities should be supplied so that possible tolerances can be compensated which have been caused by drilling fastening holes into the parts of the piece of furniture.

It has been experienced that not every hinge has to or would have to be additionally adjusted after assembling but that the fastening holes for the mounting plate are in general drilled precisely enough and that the mounting plate is on the whole positioned precisely enough so that the hinge arm can always be fixed on the same point of the mounting plate.

On the other hand it is a fact that an additional adjustment of the hinge becomes frequently necessary.

It can be concluded that in most cases it is not necessary to adjust the hinge arm on the mounting plate in a special way in order to compensate assembling faults in the depth of the piece of furniture for example but there must be some adjustability so that an adjustment can be carried out, if necessary.

SUMMARY OF THE INVENTION

It is relatively time-consuming to adjust a hinge in the depth of the piece of furniture. It is, therefore, the object of the present invention to create a hinge whereby the hinge arm can be put into position with the help of some guiding device and fixed so that any time-consuming adjustment can be avoided. If a correction becomes necessary later on there should be a possibility of adjustment.

According to the invention this is achieved by placing on the slide-in path of the hinge arm at least one stop which rests against a counter-stop if the hinge arm is positioned on the mounting plate whereby said counter-stop is for example formed by a cross-piece of the preferably U-profiled hinge arm or by a projecting part of the mounting plate whereby stop and counter-stop belong to different structural parts.

It is of advantage with regard to known hinges that the mechanic presses the door on the mounting plate as far as the stop and fastens it afterwards. Thereby the stop is for example positioned in such a way that a clearance of about 0.5 to 1mm results between the door and the corpus if the door is in the closed position.

Adjusting the hinge and the wing of the door in the forward direction at the same time does not create any furthur problems. If an adjustment of the door in the backward direction is desired the stop will be removed or pushed aside.

A correction of the hinge resp. of the position of the hinge arm on the mounting plate in the depth of the piece of furniture in the backward direction will become necessary if the joint of the door is adjusted to a rather high extent and thus moves away from the corpus.

In the following different embodiments of the invention will be described by the figures of the attached drawings without being limited thereto.

DESCRIPTION OF THE PREFERRED EMBODIMENTS

Figure 1:
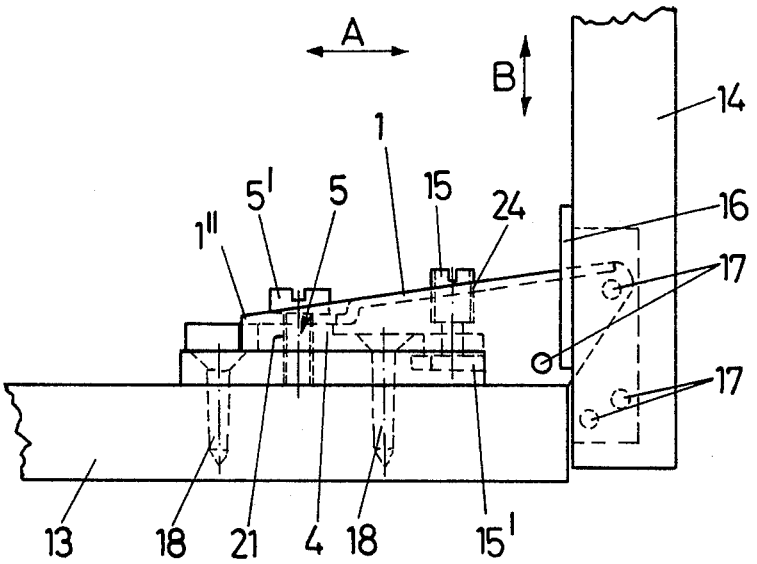
FIG. 1 is a schematic longitudinal section of a hinge according to the invention.

As can specially be seen in FIG. 1 the hinge according to the invention consists mainly of the mounting plate 2, the hinge arm 1 and the hinge casing 16 whereby the hinge arm 1 and the hinge casing 16 are linked to each other by links which are not illustrated and which are mounted in the bearings of the links 17 of the hinge arm 1 and the hinge casing 16.

The hinge casing 16 is inserted into a bore in the door wing 14 and the mounting plate 2 is fixed to the other part of the piece of furniture 13 which represents for example a side-panel by means of supporting screws 18.

Figure 2:
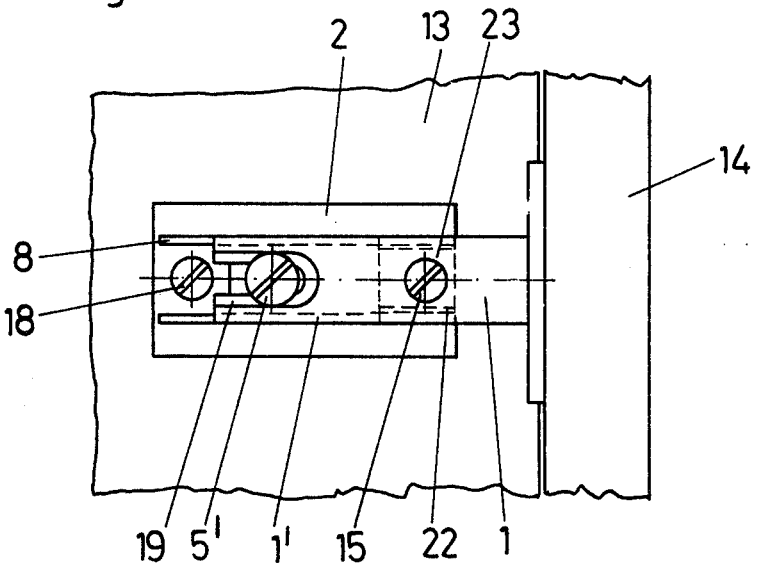
FIG. 2 is a plan view of a hinge according to FIG. 1.

Specially FIG. 2 shows the longitudinal slot 19 in the hinge arm 1 which is open towards the end of the hinge arm, the head 5' of the fastening screw 5 which penetrates this longitudinal slot as well as the end of the screw of an intermediate part which has the shape of a thread bolt 15.

In FIG. 1 the desired adjustabilities are indicated by arrows. Arrow A shows the adjusting direction in the depth of the piece of furniture and arrow B shows the adjusting direction in the joint of the door.

A hinge according to this embodiment makes an adjustment in these two directions possible. This embodiment will be described in the following.

The mounting plate 2 is fixed to the part of the piece of furniture 13 by supporting screws 18. In the backward portion the mounting plate 2 is provided with a base 4 which has an internal thread 21 into which the screw 5 is screwed. In the forward portion the mounting plate 2 has projections 22 which are directed towards its longitudinal central axis, i.e. inwards directed, and delimit a recess 23 in the mounting plate 2.

The hinge arm 1 is provided with a female screw thread 24 into which an intermediate part is screwed which has the shape of a thread bolt 15 whose head 15' stretches behind the projections 22 in the assembled position.

The hinge arm 1 is further provided with the longitudinal slot 19 at the end which is turned away from the bearings 17 for the axes of the links.

For assembling the door wing 14 the hinge arm 1 is positioned on the mounting plate 2 in such a way that the hinge arm 1 is pushed with its longitudinal slot 19 underneath the head 5' of the fastening screw 5 which has already been mounted on the mounting plate 2 (in the direction of arrow C) whereby the head 15' of the thread bolt 15 at the same time comes to lie underneath the projections 22 of the mounting plate 2.

Thus the hinge arm 1 is already anchored on the mounting plate 2 and the door wing 14 is kept in position.

In order to mount the hinge arm 1 in a zero position on the mounting plate 2 without any special adjusting work by a mechanic the mounting plate 2 is provided with cross-pieces 8 whereby each of them forms a stop for the hinge arm 1 by having the same alignment as the two parallel cross-pieces 1' of the hinge arm 1.

The hinge arm 1 must therefore only be pushed as far as the stop which means as far as the cross-pieces 8 and can then be fixed by fastening the fastening screw 5. In most cases a more precise adjustment in the depth of the piece of furniture will not be necessary. If necessary, the adjustment of the hinge in the joint of the door which means in the direction of the double-arrow B can be effected by turning the thread bolt 15.

If, however, an adjustment of the hinge in the depth of the piece of furniture namely in the backward direction becomes necessary the cross-pieces 8 can be bent aside in the illustrated embodiment.

Figure 5A:
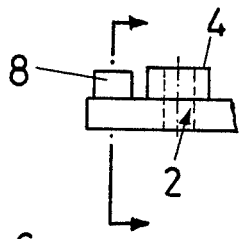
FIG. 5a is a side-view and FIG. 5b is a cross-section.
Figure 5B:
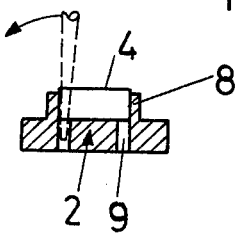
Figure 6A:
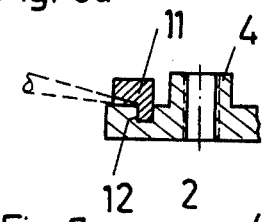
FIG. 6a is a view of the mounting plate from the back and FIG. 6b is a longitudinal section.
Figure 6B:
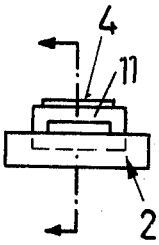

This is specially illustrated in FIGS. 5a and 5b in which recesses 9 can be seen which are placed on the inner side of the cross-pieces 8 in respect of the longitudinal central axis of the mounting plate and which allow to apply tools, a screwdriver for example, in order to bend the cross-pieces 8. When the cross-pieces 8 are pushed aside the hinge arm 1 can be adjusted in the depth of the piece of furniture as needed.

Figure 7A:
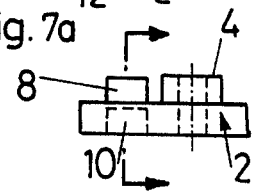
FIG. 7a is a side-view and FIG. 7b is a cross-section.
Figure 7B:
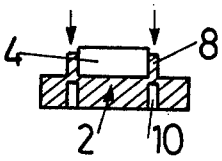
Figure 8A:
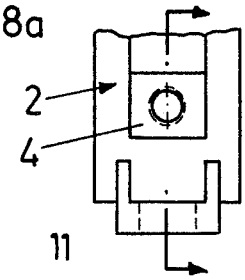
FIG. 8a is a plan view and FIG. 8b is a longitudinal section.
Figure 8B:
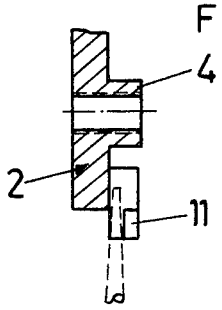

FIGS. 7a and 7b show a similar embodiment of the stops like FIGS. 5a and 5b; in this case, however, the recesses 10 are positioned underneath the cross-pieces 8. If an adjustment of the hinge arm 1 becomes necessary the cross-pieces 8 can easily be driven into the mounting plate 2 with a suitable tool, a hammer for example.

FIGS. 6a, 6b, 8a, and 8b, show similar embodiments whereby the task of the stop is carried out by a clamp 11 instead of the cross-pieces 8. As shown in FIG. 8 the clamp 11 can be mounted on the mounting plate 2 and can be torn off if an adjustment of the hinge arm becomes necessary. In the embodiment illustrated in FIGS. 6a and 6b the clamp 11 is made as separate part and is mounted in bearings in a recess 12 in the mounting plate.

Figure 9A:
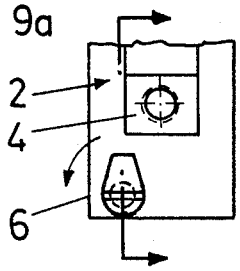
FIG. 9a is a plan view and FIG. 9b is a longitudinal section.
Figure 9B:
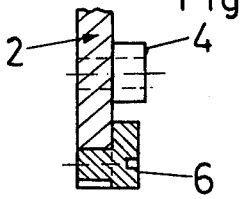

In the embodiment according to FIGS. 9a and 9b the stop is formed by a crank arm 6 which is mounted in bearings in the mounting plate and which determines in its position illustrated in FIGS. 9a and 9b the zero position of the hinge arm 1 which rests with one of its parallel cross-pieces 1' against the crank arm 6 in the pushed-in position. If an adjustment of the hinge arm 1 in the depth of the piece of furniture in the backward direction is desired the crank arm 6 has only to be turned sideways.

Figure 11A:
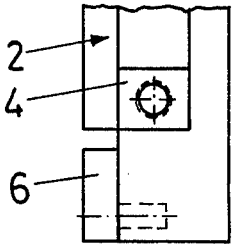
Figure 11B:
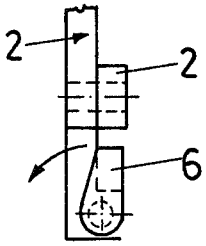
Figure 12:
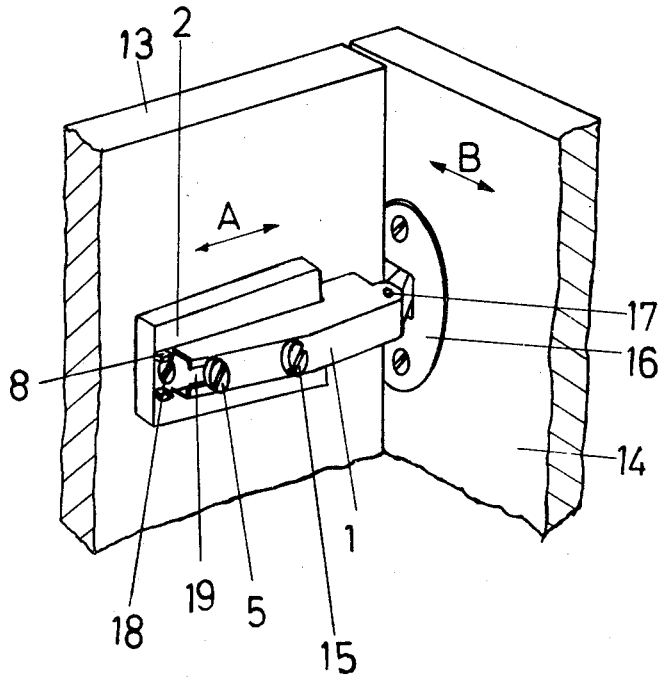
FIG. 12 is a three-dimensional representation of the hinge according to the invention.

The embodiment according to FIGS. 11a and 11b show an example whereby the crank arm 6 is positioned on the side of the mounting plate 2.

Figure 10A:
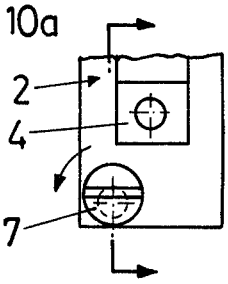
FIG. 10a is a plan view and FIG. 10b is a longitudinal section and FIG. 11a is a plan view and FIG. 11b is a side-view.
Figure 10B:
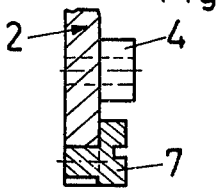

In the embodiment according to FIGS. 10a and 10b the stop according to the invention is formed by an eccentric 7 whose function is similar to the one of the crank arm 6 which has already been described.

Figure 3:
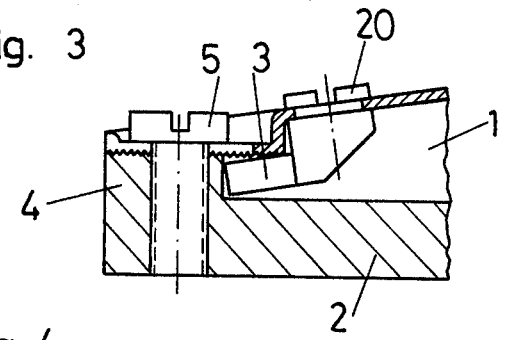
FIG. 3 is a longitudinal section of that part of the hinge which carries the stop.
Figure 4:
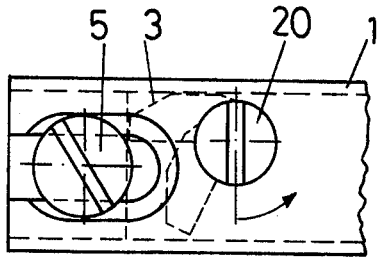
FIG. 4 is a plan view of an end of the hinge according to FIG. 3 and FIGS. 5a through 11b are schematically different embodiments of a mounting plate of a hinge according to the invention whereby

FIGS. 3 and 4 show embodiments whereby the stop is not mounted in bearings on the mounting plate 2 according to the above-mentioned embodiments but on the hinge arm 1 and whereby the stop is formed by a crank arm 3 mounted in bearings on the rear end of the hinge arm 1 and according to FIG. 3 strutted against the base 4 of the mounting plate 2 which forms the counter-stop. If an adjustment of the hinge arm 1 in the depth of the piece of furniture in the backward direction becomes necessary the crank arm 3 is turned as illustrated in FIG. 4. In this embodiment the head 20 of the crank arm 3 is riveted into the hinge arm 1.

What is claimed is:

1. A hinge arrangement particularly for pieces of furniture comprising a mounting plate which can be positioned on a piece of furniture, a hinge arm carrying link means anchorable on said mounting plate, at least one stop placed in the path of motion of said hinge arm, a counter-stop, said first mentioned resting against said counter-stop when said hinge arm is positioned on said mounting plate, said hinge arm having a U-shaped profile and a cross-member, said counter-stop being formed by said cross-member of said hinge arm, said stop and said counter-stop being on different parts of furniture, said stop being displaceable and forcing said hinge arm in a position on said mounting plate corresponding to a predetermined position of the hinge arm, said stop being displaceable for adjusting said position.

2. A hinge arrangement according to claim 1 including a crank arm mounted in bearings in said hinge arm, said stop being formed by said crank arm, said mounting plate having a projection forming said counter-stop.

3. A hinge arrangement according to claim 2 wherein said projection comprises a base, and a fastening screw mounted in bearings in said base.

4. A hinge arrangement according to claim 1 wherein said stop comprises a crank arm mounted in bearings in said mounting plate.

5. A hinge arrangement according to claim 1 wherein said stop comprises an eccentric member mounted in bearings in said mounting plate.

6. A hinge arrangement according to claim 1 wherein said stop comprises a cross-member formed on said mounting plate.

7. A hinge arrangement according to claim 6 wherein said mounting plate has a recess position adjacent said cross member on a side turned towards a longitudinal central axis of said mounting plate.

8. A hinge arrangement according to claim 6 including recess means positioned underneath said cross member.

9. A hinge arrangement according to claim 8 wherein said hinge arm has parallel counter-elements, said counter-stop being formed by at least one of said parallel counter-elements.

10. A hinge arrangement according to claim 9 wherein two stops are on said mounting plate and rest against said parallel counter-elements.

11. A hinge arrangement according to claim 1 including a clamp on said mounting plate and forming said stop.

12. A hinge arrangement according to claim 11 wherein said clamp means comprises a separate part mounted in bearings in at least one recess in said mounting plate.

* * * * *